US007823304B2

(12) United States Patent
You

(10) Patent No.: US 7,823,304 B2
(45) Date of Patent: Nov. 2, 2010

(54) METHOD AND DEVICE FOR FORMING STEAM

(76) Inventor: Tuming You, 265 Jia He Road, No. 2102, Xiamen (CN)

( * ) Notice: Subject to any disclaimer, the term of this patent is extended or adjusted under 35 U.S.C. 154(b) by 838 days.

(21) Appl. No.: 11/712,306

(22) Filed: Feb. 27, 2007

(65) Prior Publication Data

US 2008/0047172 A1 Feb. 28, 2008

(51) Int. Cl.
*D06F 75/24* (2006.01)
*F22B 37/12* (2006.01)
*D06F 75/26* (2006.01)

(52) U.S. Cl. ..... 38/77.83; 38/77.9; 38/77.81; 122/235.14

(58) Field of Classification Search ..... 38/74, 38/77.1, 77.3, 77.5–77.83, 77.9, 82, 93; 122/36, 122/235.14, 235.23, 511; 239/135; 137/154
See application file for complete search history.

(56) References Cited

U.S. PATENT DOCUMENTS 1,072,257 A * 9/1913 Pollock ..... 38/77.6
1,597,427 A * 8/1926 Brenizer ..... 38/77.6
1,666,599 A * 4/1928 Hoffman ..... 38/77.6
2,573,174 A * 10/1951 Bate ..... 38/77.6
3,823,497 A * 7/1974 Solomon ..... 38/77.6
3,869,816 A * 3/1975 Busby ..... 38/77.83
4,612,958 A * 9/1986 Campbell ..... 137/801
5,341,585 A * 8/1994 Stephan et al. ..... 38/77.5
5,462,229 A * 10/1995 Tanaka et al. ..... 239/397.5
6,079,640 A * 6/2000 Merritts ..... 239/532
6,082,713 A * 7/2000 King ..... 261/79.2
2003/0136104 A1 * 7/2003 Davis ..... 60/39.55
2003/0221342 A1 * 12/2003 Milanese ..... 38/93
2008/0001000 A1 1/2008 You

OTHER PUBLICATIONS

U.S. Appl. No. 11/651,903, filed Jan. 9, 2007, Tuming You.
U.S. Appl. No. 11/703,044, filed Feb. 5, 2007, Tuming You.
U.S. Appl. No. 11/938,731, filed Nov. 12, 2007, Tuming You.

* cited by examiner

*Primary Examiner*—Ismael Izaguirre
(74) *Attorney, Agent, or Firm*—Squire Sanders & Dempsey, LLP

(57) ABSTRACT

A method and device for forming steam with high pressure and a cleaner or iron comprising the device are provided.

13 Claims, 3 Drawing Sheets

METHOD AND DEVICE FOR FORMING STEAM

CROSS-REFERENCE TO RELATED APPLICATION

This application claims priority to Chinese patent application No. 200610068548.5, filed on Aug. 24, 2006, the teachings of which are incorporated herein by reference in their entirety.

FIELD OF THE INVENTION

The present invention relates to a method and a device used for forming steam with high pressure and to a cleaner and an iron including the device.

BACKGROUND OF THE INVENTION

A method and device for forming steam with high pressure is commonly used for many kinds of facilities, especially for a steam cleaner and a steam iron.

The structure and the working principle of the steam cleaner are as follows: water from a water tank is pressed into a U-shaped tube through a water inlet of the U-shaped tube by a small water pump. The U-shaped tube is buried in a heating unit which contains the electric heating element for heating the heating unit, when the electric heating element is electrified to heat the heating unit, and the U-shaped tube is heated by the heating unit, then the water pressed into the U-shaped tube is heated into steam, so the steam that we need ejects from the outlet of the U-shaped tube, the steam can be used for cleaning the desk of the kitchen or the other greasy places where are very difficult to clean up with cold water.

The principle of the steam iron is as follows: water from a water tank drops into a steam chamber positioned on the upper side of the soleplate through a water-dropping device located on the upper side of the soleplate, and is vaporized into steam, and then the steam ejects from those small holes of the soleplate to humidify the ironed cloth.

There are many similar situations which need steam, for example, steam face massage machine, steam hair-curling machine and steam shaver etc. These devices have the same drawback that steam formed by these devices has not enough pressure to reach good efficiency.

SUMMARY OF THE INVENTION

The present invention provides a method and device for forming steam with high pressure, a cleaner and an iron with the present device. The major purpose of the present invention is to overcome the same drawback of existing technology that the steam formed by existing steam cleaner, existing steam electric iron and other existing parts cannot reach enough pressure and cannot achieve sufficiently good efficiency.

The present invention adopts the following technology solutions:

A method for forming steam with high pressure comprising:

a) heating a steam forming tube comprising an inlet and an outlet, b) pressing water into the steam forming tube with a pressure through the inlet in the steam forming tube to form a steam, c) causing an end of the outlet of the steam forming tube to form a narrow part to increase the steam pressure of vaporized water in the steam forming tube, d) causing the steam to eject from the narrow part of the steam forming tube, the inside diameter of the steam forming tube is from about 5 to about 20 mm, and the inside diameter of the outlet is from about 1 to about 3 mm, it makes the forming steam and ejecting steam increase their pressures several times since the clamp makes the outlet smaller.

A device for forming steam with high pressure, comprising: a heating unit, a water tank, an electric heating element, which is buried in the body of the heating unit and connected with the power for heating the heating unit, a steam forming tube, which is buried in the body of the heating unit, containing an intake and an outlet, a water pump, which is set between the water tank and the inlet of the steam forming tube, for pressing water of the water tank into the steam forming tube, a narrow part is formed on the outlet of the steam forming tube for increasing the steam pressure of vaporized water in the steam forming tube, the inside diameter of the steam forming tube is from about 5 to about 20 mm, and the inside diameter of the outlet is from about 1 to about 3 mm.

The device, wherein the cross section of the narrow part is squat-shaped.

The device, wherein the steam forming tube is a soft tube, and near the inlet of the steam pipe there is a clamp which causes the inside diameter of the steam forming tube to become smaller for forming a narrow part.

The device, wherein the cross section of the narrow part is round-shaped, and the diameter of the narrow part is smaller than the inside diameter of the steam forming tube.

The device, wherein the narrow part is a diameter-changing pipe tie-in, one end being connected with the steam forming tube, the other end being connected with the steam outlet pipe.

The device, wherein the steam forming tube is a U-shaped tube, and the two ends of the steam forming tube extend to the outside of the heating unit for forming the outlet and the inlet. Certainly the steam forming tube can also be a straight tube a tube of another shape;

A cleaner, comprising: a shell, the device is set inside the shell, the electric heating element of the device is connected with a power cord, the power cord extending to the outside of the shell to connect with external power for obtaining electric energy; the water tank of the device comprises a water inlet that comprises a sealing cover which is located on the outside of the shell and can be opened from the outside of the shell to cause the water inlet to expose; and the outlet of the steam forming tube of the device forms a steam ejecting hole which is set outside of the shell;

A steam iron with a device for forming steam with high pressure comprising: (a) a main body, (b) a soleplate set on the bottom of the main body, the soleplate comprising (a) several holes which causes the steam of the steam chamber to eject outward and (b) a heating unit which heats the soleplate, (c) a steam chamber set on the upper side of the soleplate, and (d) a device for forming steam with high pressure is set inside the main body of the iron, the electric heating elements of the device and the soleplate are connected with a power cord and the power cord extends to the outside of the iron main body to connect with external power to obtain electric energy; the water tank of the device comprises a water inlet for forming steam with high pressure, the water inlet comprising a sealing cover located on the outside of the iron body which can be opened from outside of the iron body to cause the water inlet to expose; and the outlet of the steam forming tube of the device is connected with the steam chamber.

It is known from the description for the structure of the present invention, compared with the existing technology, that the advantages of the present invention are as following: (a) a narrow part is formed on the outlet of the mentioned device used for steam cleaner, steam iron and other appliances in a creative way, so that the pressure created by the present device is several times higher than existing devices; (b) it can prevent the water droplets mixing with steam and ejecting out to generate the pure steam; (c) compared with boiler steam generator, it uses simple structure and lower cost to reach the purpose of generating the steam with high pressure; (d) although the principle and the structure for increasing pressure is very simple, it provides a innovative way for increasing pressure to achieve a sufficiently good efficiency in the technology field.

DESCRIPTION OF SPECIFIC EMBODIMENTS

Figure 1:
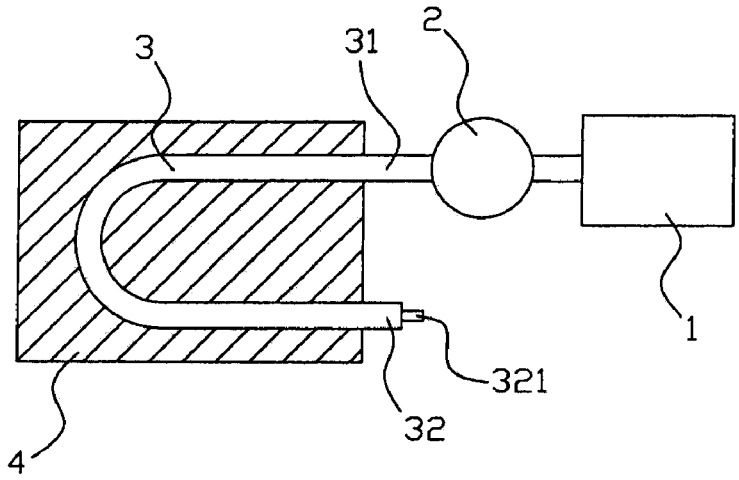
FIG. 1 is a structural view of the present utility model.
Figure 2:
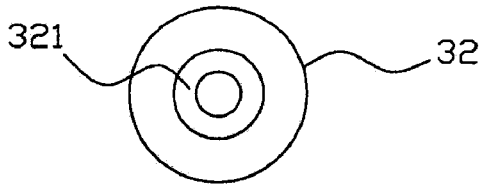
FIG. 2 is a structural view of the narrow part on steam forming tube of the present utility model.

Referring to FIG. 1, the device for forming steam with high pressure comprises a heating unit 4, a water pump 2, a water tank 1, an electric heating element and a steam forming tube 3 buried in the heating unit 4. The electric heating element is connected with the power for heating the heating unit, and it doesn't show on the figure; the steam forming tube 3 contains an inlet 31 and an outlet 32; the water pump 2 which is set between water tank 1 and inlet 31 of the steam forming tube 3, for pressing water of the water tank 1 into the steam forming tube 3; a narrow part 321 is formed on the outlet 32 of the steam forming tube 3 for increasing the steam pressure of vaporized water in the steam forming tube 3;

Referring to FIG. 2, the cross section of the narrow part 321 is round, and the diameter of the narrow part is smaller than the inner diameter of the steam forming tube 3; it can be a separate body structure: through a pipe tie-in one end connected to steam forming tube 3, the other end connected to the narrow part 321 of the steam forming tube; it can also be a single body structure: the end connected to the steam forming tube 3 is directly shaped to a narrow part 321, it can also be another structure according to the purpose of the present invention.

Figure 3:
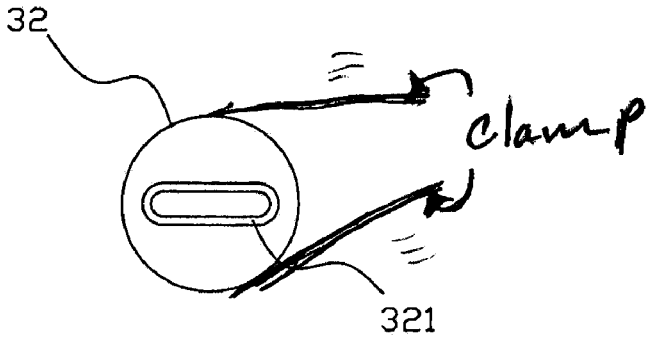
FIG. 3 is a other structural view of the narrow part on steam forming tube of the present utility model.

Referring to FIG. 3, the cross section of the narrow part 321 can be squat shaped. The steam forming tube 3 is a soft tube, near the inlet of the steam pipe there is a clamp which causes the inside diameter of the steam forming tube to become smaller for forming a narrow part 321;

No mater what kind of tube shape the narrow part 321 is, the main purpose is to increase the inner steam pressure of the steam forming tube 3 and cause the ejecting pressure to become higher. The steam forming tube 3 is a U-shaped tube, and two ends of the steam forming tube extend to the outside of the heating unit 4 for forming the inlet 31 and the outlet 32. Certainly, the steam forming tube 3 can also be an S-shaped tube, a straight tube or a tube of any other shape, as long as it ensures that water pressed by the water pump 2 moves in the steam forming tube and be vaporized into steam.

The inside diameter of the steam forming tube 3 is from about 5 to about 20 mm, the inside diameter of the narrow part 321 of the tube is from about 1 to about 3 mm, it is proved by testing that the diameter within the above range can realize the purpose of the present invention, the favorite diameter of the narrow part 321 of the tube is about 1.5 mm.

The device for forming steam with high pressure has the following process: a) heating a steam forming tube 3 comprising an inlet and an outlet by the heating unit 4; b) pressing water into the steam forming tube 3 with a pressure through the inlet 31 in the steam forming tube 3 to form steam by the water pump 2; c) water vaporizes into steam in the steam forming tube 3, and steam ejects from the narrow part 321 with high pressure. The reason is that the narrow part 321 which is formed on the end of the outlet 32 of the steam forming tube 3 can increase the steam pressure and let the pressure of ejecting steam from narrow part 321 several times higher than the existing structure.

Figure 4:
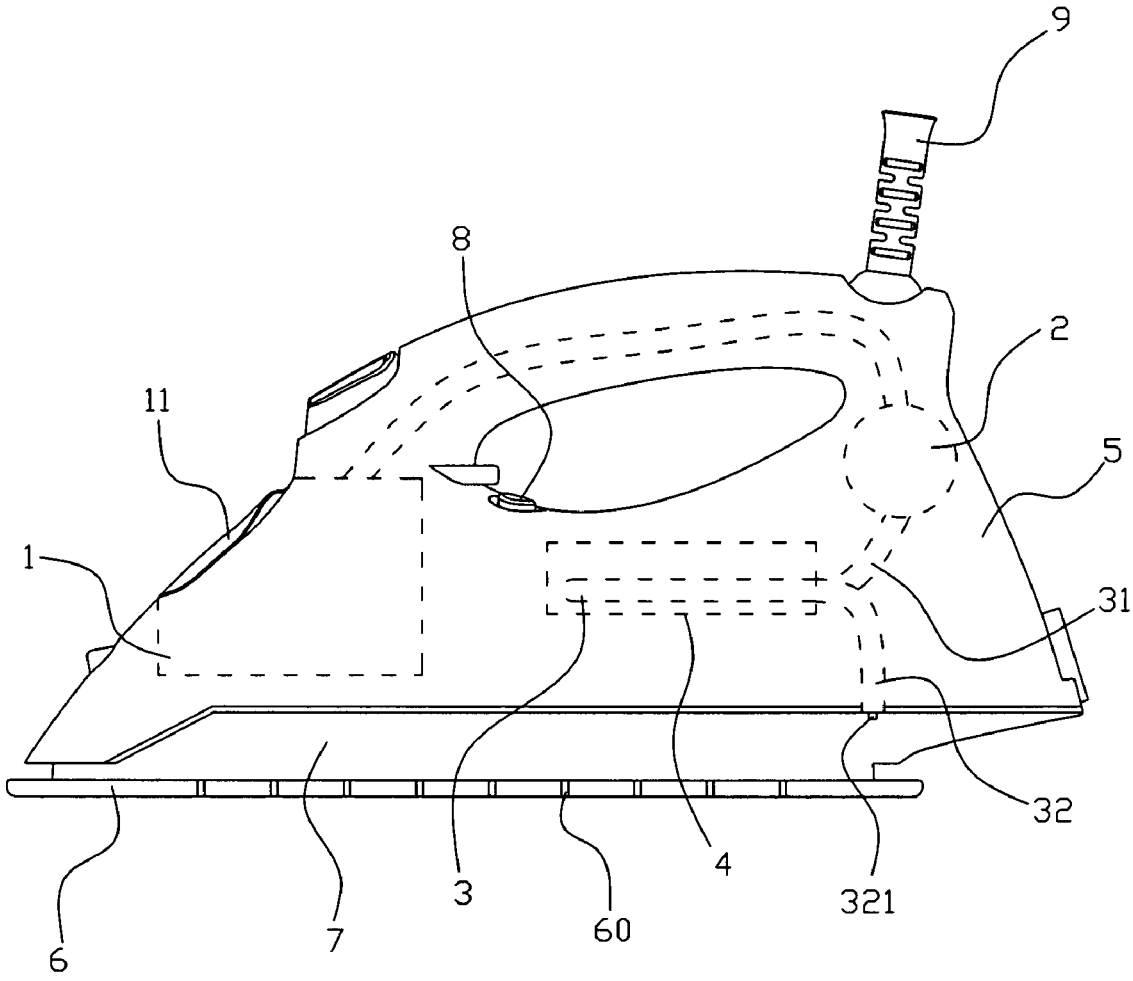
FIG. 4 is a structural view of the first embodiment of the present utility model.

Referring to FIG. 4, an embodiment of the present invention provides a steam iron with the device for forming steam with high pressure, and steam with a specific pressure ejecting from the bottom of the soleplate to cause cloth that receives ironing to be humidified. The steam iron comprises an iron body 5, a soleplate 6 set on the bottom of the iron body 5, the soleplate comprising (a) several holes 60 which causes the steam of the steam chamber 7 to eject outward and (b) a heating unit which heats the soleplate 6; a steam chamber 7 set on upper side of the soleplate 6, the heating unit with the present technology comprises electric heating elements and it is not shown in the figure; the device for forming steam with high pressure is set in the iron body 5, the electric heating element of the device and the heating unit of the soleplate 6 are both connected with a power cord 9, and the power cord 9 extends to the outside of the iron body 5 to connect with an external power source to obtain electric energy; the water tank 1 of the device comprises a water inlet for forming steam with high pressure, the water inlet comprising a sealing cover 11 located on the outside of the iron body 5 which can be opened from outside of the iron body 5 to cause the water inlet to expose; and the outlet 32 of the steam forming tube 3 of the device is connected with the steam chamber 7, and steam can eject into the steam chamber 7 from the narrow part 321, the water inlet 31 is connected with water pump 2. Furthermore, the water tank 1 is set on the front of the iron body 5, and the water pump 2 is on the rear of the iron body 5; a power switch 8 which is fixed on the iron body 5 can control the electric heating element of the heating unit 4, and the soleplate 6 can be connected to electricity or disconnected from electricity.

Figure 5:
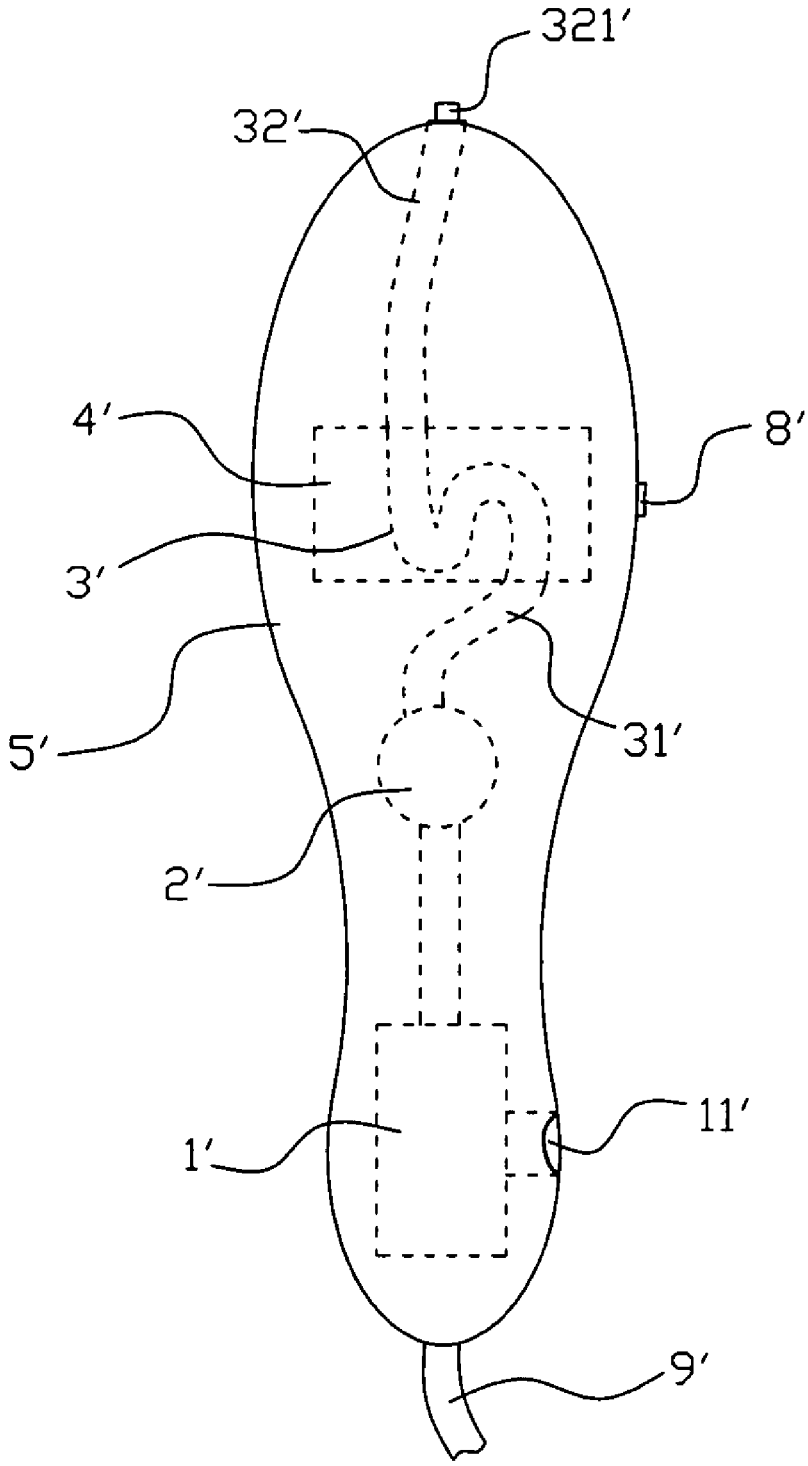
FIG. 5 is a structural view of the second embodiment of the present utility model.

Referring to FIG. 5, the second embodiment of the present invention provides a steam cleaner with the device for forming steam with high pressure, it can be used for cleaning the desk of the kitchen or the other greasy places where are very difficult to clean up with cold water. The cleaner comprises a shell 5', the device is set inside the shell 5', the electric heating element of the device and water pump 2' are connected with a power cord 9', and the power cord 9' extending to the outside of shell 5' to connect with external power for obtaining electric energy; the water tank 1' of the device comprises a water inlet that comprises a sealing cover 11' which is located on the outside the shell 5', and can be opened from the outside of the shell 5' to cause the water inlet to expose, and the outlet 32' of the steam forming tube 3', 31' of the device forms a steam ejecting hole 321' which is set on the outside of the shell 5', a power switch 8' is fixed on a appropriate place of shell 5' to control the electric heating element of the heating unit 4' and water pump 2' closed or opened. The steam forming tube 3', 31' is s-shaped.

The device for forming steam with high pressure can be used for steam face-massage machine, steam-curling machine, steam shaver, steam mop and other appliances as well.

As mentioned above, they are only several embodiments; they do not limit the scope of the present invention. The equivalent changes and modifications based on the content of the present invention fall within the scope of the present invention.

INDUSTRY PRACTICABILITY

The present invention of the device for forming steam with high pressure increases the pressure of the steam made from water in steam forming tube through causing the diameter of the end of the outlet of steam forming tube to become smaller and make the steam eject out from the narrow part of the steam forming tube, the present invention structure is simple, its application is wide, and has great practicablity.

I claim:

1. A device for forming steam with high pressure, comprising:

a heating unit, a water tank, an electric heating element, which is buried in the body of the heating unit and connected with the power for heating the heating unit, a steam forming tube, which is buried in the body of the heating unit, containing an intake and an outlet, a water pump, which is set between the water tank and the inlet of the steam forming tube, for pressing water of the water tank into the steam forming tube, wherein a narrow part is formed on the outlet of the steam forming tube for increasing the steam pressure of vaporized water in the steam forming tube, wherein the inside diameter of the steam forming tube is from about 5 to about 20 mm, wherein the inside diameter of the outlet is from about 1 to about 3 mm, wherein the steam forming tube is a soft tube, and wherein near the inlet of the steam pipe there is a clamp which causes the inside diameter of the steam forming tube to become smaller for forming a narrow part.

2. The device of claim 1, wherein the cross section of the narrow part is squat-shaped.

3. The device of claim 1, wherein the cross section of the narrow part is round-shaped, and wherein the diameter of the narrow part is smaller than the inside diameter of the steam forming tube.

4. The device of claim 3, wherein the narrow part is a diameter-changing pipe tie-in, one end being connected with the steam forming tube, the other end being connected with the steam outlet pipe.

5. The device of claim 1, wherein the narrow part is a diameter-changing pipe tie-in, one end being connected with the steam forming tube, the other end being connected with the steam outlet pipe.

6. The device of claim 1, wherein the steam forming tube is a U-shaped tube, and wherein the two ends of the steam forming tube extend to the outside of the heating unit for forming the outlet and the inlet.

7. A cleaner, comprising the device of claim 4, and a shell, wherein the device is set inside the shell, wherein the electric heating element of the device is connected with a power cord, the power cord extending to the outside of the shell to connect with external power for obtaining electric energy;

wherein the water tank of the device comprises a water inlet that comprises a sealing cover which is located on the outside of the shell and can be opened from the outside of the shell to cause the water inlet to expose; and wherein the outlet of the steam forming tube of the device forms a steam ejecting hole which is set outside of the shell.

8. The cleaner of claim 7, wherein the cross section of the narrow part is round- or squat- shaped.

9. The cleaner of claim 7, wherein the steam forming tube is a U-shaped tube, the two ends of the steam forming tube extending to the outside of the heating unit for forming the outlet and the inlet.

10. A device for forming steam with high pressure, comprising:

a heating unit, a water tank, an electric heating element, which is buried in the body of the heating unit and connected with the power for heating the heating unit, a steam forming tube, which is buried in the body of the heating unit, containing an intake and an outlet, a water pump, which is set between the water tank and the inlet of the steam forming tube, for pressing water of the water tank into the steam forming tube, wherein a narrow part is formed on the outlet of the steam forming tube for increasing the steam pressure of vaporized water in the steam forming tube, wherein the inside diameter of the steam forming tube is from about 5 to about 20 mm, wherein the inside diameter of the outlet is from about 1 to about 3 mm, wherein the cross section of the narrow part is squat-shaped, wherein the steam forming tube is a soft tube, and wherein near the inlet of the steam pipe there is a clamp which causes the inside diameter of the steam forming tube to become smaller for forming a narrow part.

11. A steam iron with a device for forming steam with high pressure comprising:

(a) a main body, (b) a soleplate set on the bottom of the main body, the soleplate comprising (a) several holes which causes the steam of the steam chamber to eject outward and (b) a heating unit which heats the soleplate, (c) a steam chamber set on the upper side of the soleplate, and (d) a device for forming steam with high pressure, wherein the device for forming steam with high pressure comprises:

a heating unit;

a water tank;

an electric heating element, which is buried in the body of the heating unit and connected with the power for heating the heating unit;

a steam forming tube, which is buried in the body of the heating unit, containing an intake and an outlet; and a water pump, which is set between the water tank and the inlet of the steam forming tube, for pressing water of the water tank into the steam forming tube;

wherein a narrow part is formed on the outlet of the steam forming tube for increasing the steam pressure of vaporized water in the steam forming tube;

wherein the inside diameter of the steam forming tube is from about 5 to about 20 mm;

wherein the inside diameter of the outlet is from about 1 to about 3 mm;

wherein the electric heating elements of the device and the soleplate are connected with a power cord and the power cord extends to the outside of the iron main body to connect with external power to obtain electric energy;

wherein the water tank of the device comprises a water inlet for forming steam with high pressure, the water inlet comprising a sealing cover located on the outside of the iron body and can be opened from outside of the iron body to cause the water inlet to expose; and wherein the outlet of the steam forming tube of the device is connected with the steam chamber.

12. The steam iron of claim 11, wherein the cross section of the narrow part is round- or squat- shaped.

13. The steam iron of claim 11, wherein the steam forming tube is a U-shaped tube, the two ends of the steam forming tube extending to the outside of the heating unit for forming the outlet and the inlet.

* * * * *